United States Patent [19]

Holm

[11] Patent Number: 4,548,552

[45] Date of Patent: Oct. 22, 1985

[54] DUAL VALVE WELL PUMP INSTALLATION

[76] Inventor: Daniel R. Holm, 5650 Timbercreek Place Dr., #505, Houston, Tex. 77084

[21] Appl. No.: 581,500

[22] Filed: Feb. 17, 1984

[51] Int. Cl.[4] ..... F04B 17/04

[52] U.S. Cl. ..... 417/417; 417/422

[58] Field of Search ..... 417/417, 416, 415, 422, 417/554, 259, 254, 244

[56] References Cited

U.S. PATENT DOCUMENTS

| | | | |
|---|---|---|---|
| 1,655,825 | 1/1928 | Schmidt | 417/417 |
| 1,840,994 | 1/1932 | Winsor | 417/417 |
| 2,377,743 | 6/1945 | Arutunoff | 417/415 |
| 2,478,701 | 8/1949 | Maginniss | 417/422 |
| 2,817,298 | 12/1957 | Blondoff | 417/554 |
| 2,975,722 | 3/1961 | Webber | 417/554 |
| 3,031,970 | 5/1962 | Hoblitzelle | 417/417 |
| 3,397,643 | 8/1968 | Jepsen | 417/415 |
| 3,514,228 | 5/1970 | Toyoda | 417/416 |
| 4,169,695 | 10/1979 | Masuda et al. | 417/417 |
| 4,243,361 | 1/1981 | Groff | 417/554 |

*Primary Examiner*—Cornelius J. Husar
*Assistant Examiner*—Peter M. Cuomo

[57] ABSTRACT

A reciprocating electric motor-pump assembly for lifting well fluid on downstroke of the motor pump assembly, the pump including a barrel below the motor having dual combined inlet and outlet valve means at the lower end thereof, the pump piston moving in the barrel having annular grooves therearound to prevent differential pressure sticking, the electric cable supplying the electric motor being tubular to vent the pump and prevent vacuum or gas lock, there being a packer about the valve barrel separating the outlet valve means thereabove from the inlet valve means therebelow and a packer above the motor about a production tubing including an upper standing valve.

5 Claims, 5 Drawing Figures

Fig. 1
(SCHEMATIC)
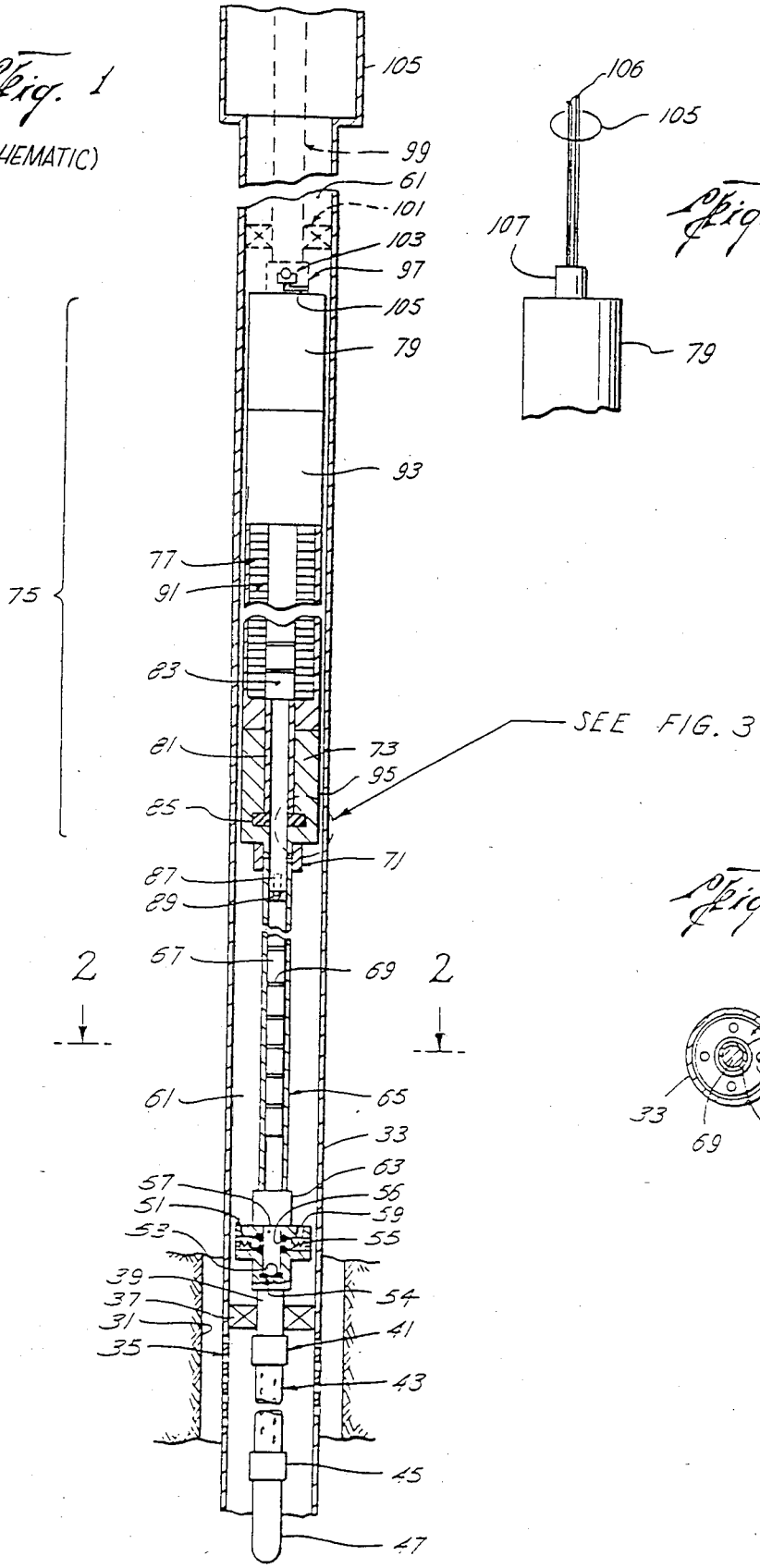
Fig. 4
Fig. 2
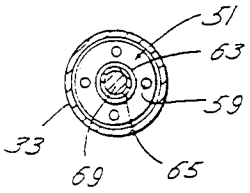

DUAL VALVE WELL PUMP INSTALLATION

SUMMARY OF THE INVENTION

This invention relates to pumps and more particularly to a down-hole well pump driven by a downhole reciprocating electric motor thereabove.

If a downhole reciprocating motor is placed above a conventional well pump including a barrel with a standing valve and a plunger or piston with a traveling valve, such as is normally driven by sucker rods extending to a motor at the surface, two problems arise. First of all, it is necessary to provide a flow path from below the motor to above the motor whereby the oil lifted by the plunger can be carried to the surface. This can be effected by providing a fluid path around the motor, e.g. by leaving room between the motor and well casing for fluid to pass by the motor on the outside, as disclosed in the draft patent application of T. A. Rabson entitled "In-Well Submersible Motor With Stacked Component Stator" (forming an exhibit to the contemporaneously filed patent application of T. A. Rabson entitled "Periodic Reciprocating Motor", now Ser. No. 542,634 filed Oct. 10, 1983). Alternately, there can be provided a fluid path through the motor, e.g. through the moving armature of the motor, the motor being tubular, as disclosed in the contemporaneously filed patent application of T. A. Rabson entitled "Down Stroke Lift Pump for Wells" (now Ser. No. 542,849, filed Oct. 17, 1983, allowed Jan. 16, 1985). A fluid path through the motor stator is undesirable since the coils therein are alternately strained in opposite directions during operation creating sufficient problems with maintenance of their insulation without adding thereto the destructive effects of an adverse ambient fluid medium such as crude oil.

A second problem encountered with a reciprocating electric motor placed above the pump arises if it is desired to lift the oil on the motor downstroke as claimed in the aforementioned application of T. A. Rabson Ser. No. 542,634 and it is not desired to employ traveling valve means and a tubular motor armature as there disclosed.

According to the present invention, a downhole well pump is provided including a barrel and a piston reciprocating therein, the piston being solid, i.e. valveless, and there being provided a dual combined inlet and outlet check valve means at the lower end of the barrel, the inlet valve being adapted for connection to a tailpipe extending through a packer to a perforated nipple adjacent the producing formation to receive crude oil, and the outlet valve means delivering crude oil to the casing annulus above the packer outside the pump barrel, for delivery to the surface by flow outside the motor. Preferably, a second or upper packer closes the annulus above the motor forcing the oil into a tubing string provided with an inlet port and standing valve.

The pump piston is provided with annular grooves to prevent differential pressure sticking, and the pump barrel is vented, e.g. via a tubular electric cable supplying electric power to the motor, to prevent gas lock.

BRIEF DESCRIPTION OF THE DRAWINGS

For a detailed description of a preferred embodiment of the invention reference will now be made to the accompanying drawings wherein:

FIG. 1 is a schematic vertical section through a well illustrating in elevation a pump driven by a motor disposed in the well in accordance with the invention;

FIG. 2 is a section at plane 2—2 of FIG. 1;

FIG. 4 is an elevation, partially in section, of the upper end of the motor.

DESCRIPTION OF PREFERRED EMBODIMENT

Motor/Pump Assembly in Well

Figure 3:
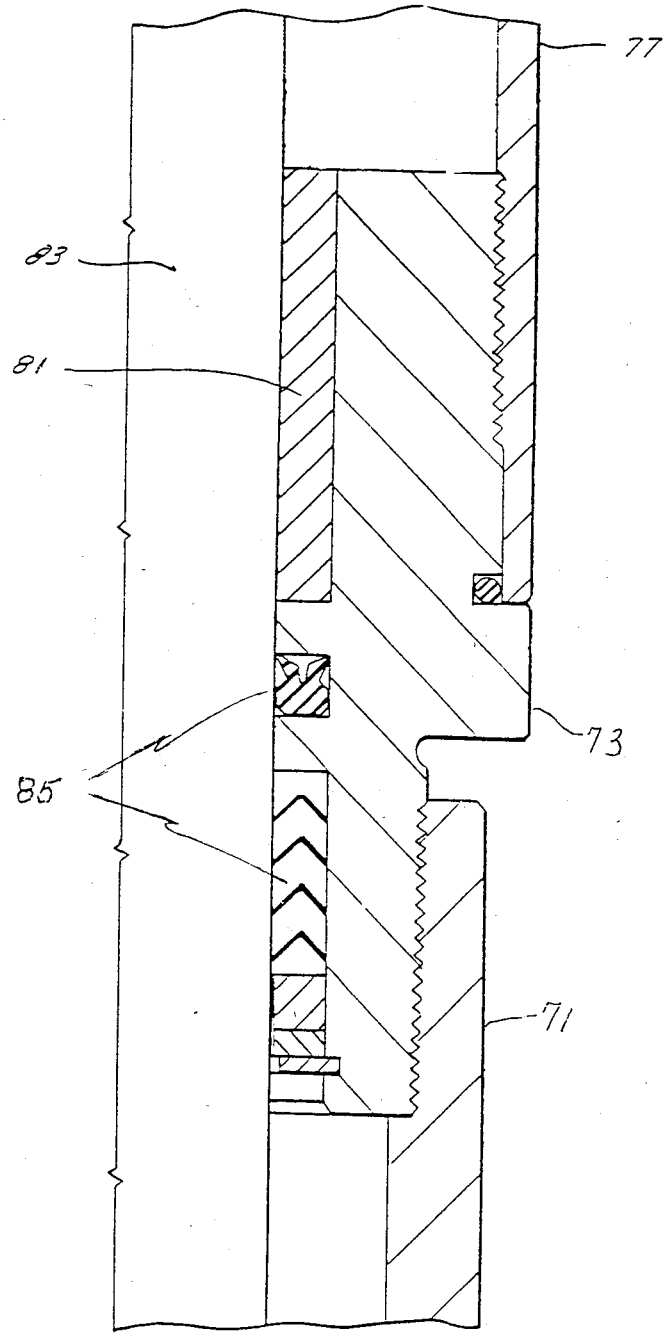
FIG. 3 is a detail to an enlarged scale of the portion circled on FIG. 1.

Referring now to FIG. 1, there is shown a well bore 31 in which is disposed a well casing 33 perforated at 35. Within the casing is set a hookwall packer 37, shown schematically since any suitable known packer may be employed, e.g. a packer as disclosed in the 1982–83 Composite Catalogue of Oil Field Equipment & Services at pages 7072, 7073 (Pengo). Extending through the packer and supported thereby and sealed thereto is a tailpipe 39 connected at its lower end by coupling 41 to perforated nipple 43, the lower end of which is connected by coupling 45 to bull plug 47 closing the lower end of the string of pipe elements. Perforated nipple 43 is opposite casing perforations 35, which are adjacent a producing formation. The casing may be secured in position in the well bore by cement (not shown).

Figure 5:
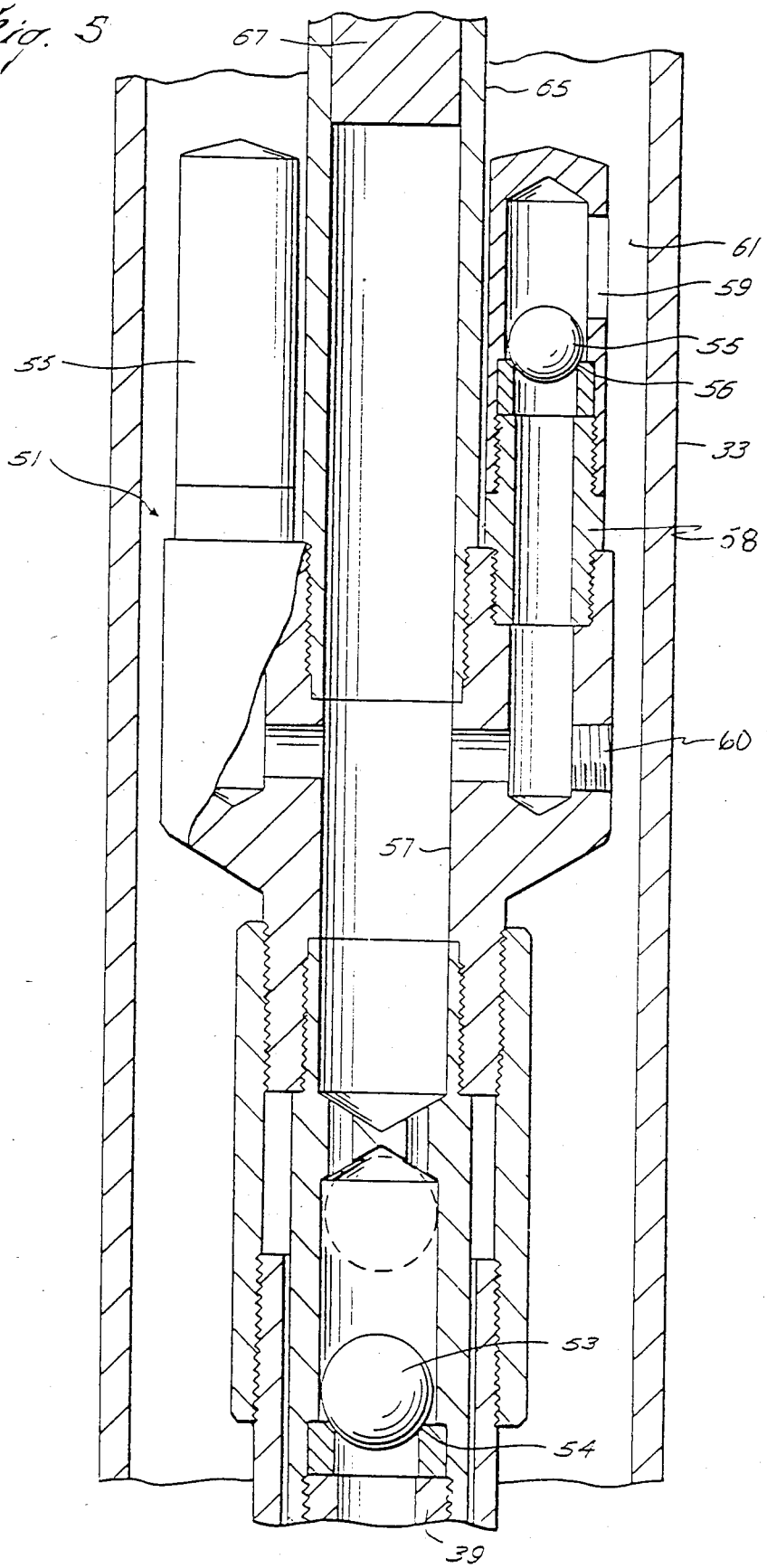
FIG. 5 is an enlarged view of the dual valve means at the lower end of the pump, bearing in mind that in FIG. 1 the showing is schematic.

Referring now to both FIGS. 1 and 5, to the upper end of tailpipe 39 is secured valve means 51 including inlet ball check valve 53, having a seat 54 coaxial and communicating with the tailpipe 39, and a plurality of lateral outlet ball check valves 55, each having a seat 56 communicating through double pin adapter nipple 58 and vertical and radial passages in the valve support body with a port in a vertical side of tubular passage 57 through the valve means. The outer end of the radial passage is closed by a screw plug 60. A plurality of upwardly opening ports 59 communicate the outlet check valves with casing annulus 61.

Referring now to FIGS. 1 and 2, at the upper end of valve means 51 is a connector 63 which connects the valve means to the lower end of pump barrel 65, which may be a cylindrical tube. Within the barrel 65, mounted for reciprocation coaxially therewithin is pump plunger 67, which may be a cylindrical rod. A plurality of pressure equalization passages around and between the barrel and plunger are formed by annular grooves 69 on the outer periphery of the plunger. The pressure equalization means prevents the plunger from becoming vacuum pressed against the side of the barrel, which would make it more difficult to move.

Referring now to FIG. 1, the upper end of pump barrel 65 is secured by screw connector 71 to lower out-board support 73 of reciprocating electric motor 75. Support 73 is bolted or in other manner suitably releasably sealingly secured to tubular (preferably cylindrical) housing 77 of the motor. Upper out-board support 79 is likewise suitably bolted or otherwise releasably sealingly secured to the upper end of motor housing 77.

Referring now to FIGS. 1 and 3, within each of supports 73, 79 is a sleeve bearing such as shown at 81, providing means mounting motor armature or mover 83 for reciprocation coaxially with bearing 81 and housing 77. Suitable annular seal means, such as that shown at 85, are provided in each of supports 73, 79 to seal between motor armature 83 and the respective supports. The lower end of the armature is secured to the pump plunger by screw connector 87, the upper end of the plunger being provided with a threaded pin 89 to receive the connector.

The motor includes field windings 91 coaxial with motor housing 77 and the motor bearings and with armature 87. Above the field windings and below support 79 is power supply 93 contained within housing 77, whereby the motor has a self-contained power supply. For further details of a suitable motor, see the aforementioned application of T. A. Rabson Ser. No. 542,634 entitled "Periodic Reciprocating Motor". Other known forms of motor could be employed.

Motor housing 77 is of smaller outer diameter than the inner diameter of well casing 33, leaving an annular passage 95 therebetween, being a continuation of and connecting the upper and lower portions of casing annulus 61.

A screw connector 97 may connect upper out-board motor support 79 with the lower end of a string of tubing 99. The tubing string is sealed to the casing by hookwall packer 101, which may be similar to packer 37. Within connector 97 is a check valve 103 for admitting fluid to the tubing from the casing annulus via lateral port 105 and preventing back flow from the tubing to the annulus. Valve 103 may be called an upper standing valve. Tubing string 99 extends to the earth's surface inside surface casing 105. Casing 33 may also extend to the surface between the tubing and outer casing or may be supported within and sealed to the latter by a conventional liner hanger-packer (not shown).

Connector 97, tubing 99, packer 101 and standing valve 103 are shown in dotted lines since they may be omitted if production is through the casing rather than the tubing.

Referring to FIG. 4, to the upper end of upper outboard motor support 79 is connected electrical conductor cable 105 for conducting electricity from the earth's surface down the well bore to motor power supply 93. Cable 105 is sealed to motor support 79 by seal means 107. If desired or necessary, cable 105 may be, as shown in FIG. 4, be tubular to admit air to the pump if necessary to break a vacuum or relieve a gas lock therein. The central passageway through the cable is shown at 106. Cable 105 and seal 107 are not shown in FIG. 1 to simplify the drawing. Seal 107 and valve 103 could be combined if cable 105 is to be threaded inside tubing 99. Otherwise, the cable will be placed in casing annulus 61 alongside tubing 99, and seal 107 will be positioned eccentrically to the motor axis alongside of valve 97, and packer 101 will be provided with an eccentric passage through which the cable can extend from below to above packer 101.

Pump Operation

In operation, when motor armature 83 moves up, lifting pump plunger 67, liquid (fluid) in tailpipe 39 will rise through inlet check valve 53 into pump barrel 65. When the armature moves down under the combined force of gravity on the pump plunger and motor armature and the action of the field windings on the armature, liquid will be forced out of the pump barrel via outlet check valves 55 into the portion of casing annulus 61 below motor 75. When the motor armature again rises, due to the action of the field windings thereon, check valves 55 will prevent back flow of liquid from the casing annulus into the pump barrel, while additional liquid is drawn up into the board through inlet check valve 53. When the motor armature again drives the pump plunger down, liquid in the barrel will be unable to move back into the tailpipe, being blocked by check valve 53, and will be forced out through outlet check valves 55 into the casing annulus below motor 75.

As the motor continues to reciprocate, more formation liquid will be driven into annulus 61, displacing whatever air, mud, water, or other fluid which was there before. The formation liquid will rise around and past and cool motor 75. The liquid will either continue to the earth's surface through the well casing (33 and/or 105) or via standing valve 97 into tubing 99 and thence to the earth's surface.

While a preferred embodiment of the invention has been shown and described, modifications thereof can be made by one skilled in the art without departing from the spirit of the invention.

I claim:

1. Apparatus comprising:

a motor pump assembly including a reciprocating motor having a stator and a mover and a pump having a barrel and an imperforate plunger, said barrel being connected to said stator, said mover being connected to said plunger, said stator and mover including electromagnet means cooperable with gravity on the down stroke of the plunger to expel fluid from the pump barrel below the plunger and elevate the fluid when the pump is suitably positioned in a wellbore, said plunger being mounted for reciprocation within said barrel, said pump including valve means connected to the lower end of the barrel, said valve means including inlet check valve means to admit fluid to the barrel and outlet check valve means to allow fluid to exit the barrel, said motor pump assembly being mounted within a well, said well including a casing coaxial with the motor and pump, a tailpipe connected to the inlet valve means, there being a fluid passage between the casing and the motor pump assembly, and a packer around the tailpipe sealing between the casing and tailpipe, said outlet valve means communicating the interior of the barrel below the plunger with the interior of the casing exterior to the motor pump assembly on the side of the packer opposite from the tailpipe, the barrel having a single longitudinally extending wall and the exterior of the barrel being at all times in open communication with the interior of the casing above the packer, said apparatus including a string of tubing inside said casing at the end of said motor pump assembly opposite from said tailpipe, a second packer around said tubing string sealing between the tubing string and casing, and a standing check valve connected to said tubing string below said second packer to admit fluid from the annulus to the tubing string.

2. Apparatus according to claim 1, including a tubular electric conductor cable connected to said motor, said cable including electric conductive means having an axial fluid passage centrally along the length thereof providing means for venting said pump via the cable.

3. Apparatus according to claim 1, and fluid passage means between said barrel and plunger extending therearound to equalize pressure around the plunger and thereby prevent pressure differential wall sticking.

4. Apparatus according to claim 1, said valve means comprising:

a tubular body having an inlet axially thereof at one end connected to said tailpipe and a plurality of outlets in the sides of the body, each outlet including a portion extending radially from the interior thereof to the exterior thereof, said inlet ball check valve means being disposed in the inlet preventing flow therethrough out of the body, and said outlet check valve means being outlet ball check valve means disposed in each outlet preventing flow therethrough into the body, said radially extending portions of the outlets all connecting to the interior of the tubular body above said inlet.

5. Apparatus according to claim 4, said body including for each outlet at the downstream end of the radial portion thereof a portion extending away from the inlet parallel to the axis of the tubular body, said outlet ball check valve means being disposed in the last said portions, said body including a one-piece tubular main section including said radially extending portions of the outlets, said portions extending parallel to the axis of the tubular body including separate tubular means threadingly connected to said main section, said outlet ball check valve means being included in said tubular means, said inlet being formed in a separate tubular outlet means threadingly connected to said tubular main sections at one end thereof, said tubular main section being interiorly threaded at said one end to receive said outlet means, inlet ball check valve means being included in said separate tubular outlet means, said tubular main section being interiorly threaded to receive said tubular outlet means, the end of said tubular main section opposite from said inlet being interiorly threaded to receive said barrel of said pump, the exterior of said tubular main section being threaded for coupling to said tail pipe.

* * * * *